US007759587B2

(12) United States Patent
Kim et al.

(10) Patent No.: US 7,759,587 B2
(45) Date of Patent: Jul. 20, 2010

(54) TWO-WAY KEY OF PORTABLE TERMINAL

(75) Inventors: Ki-Bum Kim, Gumi-si (KR); Kwang-Jin Bae, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 102 days.

(21) Appl. No.: 11/846,268

(22) Filed: Aug. 28, 2007

(65) Prior Publication Data

US 2008/0116047 A1 May 22, 2008

(30) Foreign Application Priority Data

Nov. 21, 2006 (KR) ..... 10-2006-0115094

(51) Int. Cl.
*H01H 9/00* (2006.01)

(52) U.S. Cl. ..... 200/4; 200/18; 200/568

(58) Field of Classification Search ..... 200/5 A, 200/4, 18, 511–520, 600; 345/161, 168
See application file for complete search history.

(56) References Cited

U.S. PATENT DOCUMENTS

| | | | | |
|---|---|---|---|---|
| 2,646,478 | A * | 7/1953 | Euler et al. | 335/181 |
| 3,892,931 | A | 7/1975 | Lockard | |
| 5,083,122 | A | 1/1992 | Clark | |
| 6,659,513 | B1 * | 12/2003 | Ramsauer | 292/66 |
| 6,946,606 | B2 * | 9/2005 | Kitagawa | 200/4 |
| 6,974,920 | B2 * | 12/2005 | Yu | 200/6 A |
| 7,183,513 | B2 * | 2/2007 | Park et al. | 200/500 |
| 7,253,367 | B2 * | 8/2007 | Park et al. | 200/6 A |
| 7,279,647 | B2 * | 10/2007 | Philipp | 200/5 R |

FOREIGN PATENT DOCUMENTS

| | | | |
|---|---|---|---|
| DE | 31 02 404 | A1 | 1/1982 |
| DE | 42 13 131 | A1 | 10/1993 |
| DE | 44 36 417 | C1 | 2/1996 |
| KR | 10-2006-0033225 | A | 4/2006 |
| WO | 03/043040 | A2 | 5/2003 |

* cited by examiner

*Primary Examiner*—Renee S Luebke
*Assistant Examiner*—Lisa N Klaus
(74) *Attorney, Agent, or Firm*—Jefferson IP Law, LLP

(57) ABSTRACT

A two-way key of a portable terminal is provided. The two-way terminal includes a fixed member mounted on the portable terminal, a driving member rotatably assembled with the fixed member, and an operating member pivotably assembled with the fixed member, wherein, as the driving member rotates, the driving member comes into contact with the operating member and causes the operating member to pivot. The two-way key as configured above can construct a key capable of operating in two ways while taking a small space so that it contributes to the compact size of the terminal. Further, if the two-way key is employed in the watch-type portable terminal, the operating scheme is identical to that of a spring of a common analog wrist watch or a time control lever, so that it is familiar to a user and thus it is convenient for a user to use.

20 Claims, 7 Drawing Sheets

TWO-WAY KEY OF PORTABLE TERMINAL

PRIORITY

This application claims the benefit under 35 U.S.C. §119 (a) of a Korean patent application filed in the Korean Industrial Property Office on Nov. 21, 2006 and assigned Serial No. 2006-0115094, the entire disclosure of which is hereby incorporated by reference.

BACKGROUND OF THE INVENTION

1. Field of the Invention

The present invention relates to a key of a portable terminal. More particularly, the present invention relates to a two-way key of a portable terminal used for controlling the output sound volume, shifting menu items, or the like.

2. Description of the Related Art

In general, the term "portable terminal" refers to a device used to provide wireless communication between users. The term may also refer to a device used to provide wireless communication between a user and a service provider using a mobile communication station or the like, which provides the user with various types of contents including a voice call service, short text message transmission, mobile banking, watching television, online games, video-on-demand, and so forth.

Portable terminals are classified into bar-type terminals, flip-type terminals, and folder-type terminals according to their appearance. The bar-type terminals have a communication circuit, and input/output means, such as a transmitter unit and a receiver unit, all of which are mounted on a single housing. The flip-type terminals have a flip cover assembled on a bar-type terminal and the folder-type terminals are opened/closed by pivoting a pair of housings with which an input device and an output device are provided, respectively. In addition, sliding-type terminals have recently appeared. The sliding-type terminals and the folder-type terminals are very popular and many efforts have been made to satisfy diverse tastes of users while improving the portability and the convenience of using these types of terminals.

Recently, mobile communication services, including the providing of games and moving picture file transmissions to the portable terminals through online services, mobile banking, video-on-demand, and digital multimedia broadcasting, or the like, are being increasingly diversified. The diversification of the mobile communication services is being caused by an environment in which use of the portable terminals is very common. That is, as use of portable terminals increases and user's needs become diverse, services for providing various contents through the portable terminals are being similarly diversified and commercialized.

With the continuous efforts on making terminals having a compact size, watch-type portable terminals have appeared Efforts for commercializing the watch-type portable terminals have also been continuous. The watch-type portable terminals include a microphone and a speakerphone for inputting/outputting audio information, a display device and a keypad for inputting/outputting text information, or the like. However, function keys that are used for searching information and for shifting and selecting menu items need to be positioned on the watch-type portable terminal so that a considerable problem occurs in making the terminal to be compact enough to wear it on a wrist.

Also, the input/output device such as a keypad needs to be operated by a user's hand so that there is a limitation in making the watch-type portable terminals in a compact size.

That is, if a size of a key is excessively small, a problem occurs that another key is additionally operated upon operating a key desired by a user. In addition, a two-way key used for shifting the menu items or the like should be provided with a switch member, a key button, or the like, respectively, so that a sufficient space must be secured, thereby causing a difficulty in making the terminal in a compact size.

SUMMARY OF THE INVENTION

An aspect of the present invention is to address at least the above-mentioned problems and/or disadvantages occurring in the prior art and to provide at least the advantages described below. Accordingly, an aspect of the present invention is to provide a two-way key which can be easily employed in a compact terminal, including a watch-type portable terminal.

Another aspect of the present invention is to provide a two-way key capable of operating a pair of switch members by rotating a single key.

Yet a further aspect of the present invention is to provide a two-way key which can contribute in making a portable terminal in a compact size.

In accordance with an aspect of the present invention, a two-way key of a portable terminal is provided. The two-way key includes a fixed member mounted on the portable terminal, a driving member rotatably assembled with the fixed member and an operating member pivotably assembled with the fixed member, wherein, as the driving member rotates, the driving member comes into contact with the operating member and causes the operating member to pivot.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

Throughout the drawings, it should be noted that like reference numbers are used to depict the same or similar elements, features and structures.

DETAILED DESCRIPTION OF EXEMPLARY EMBODIMENTS

Figure 1:
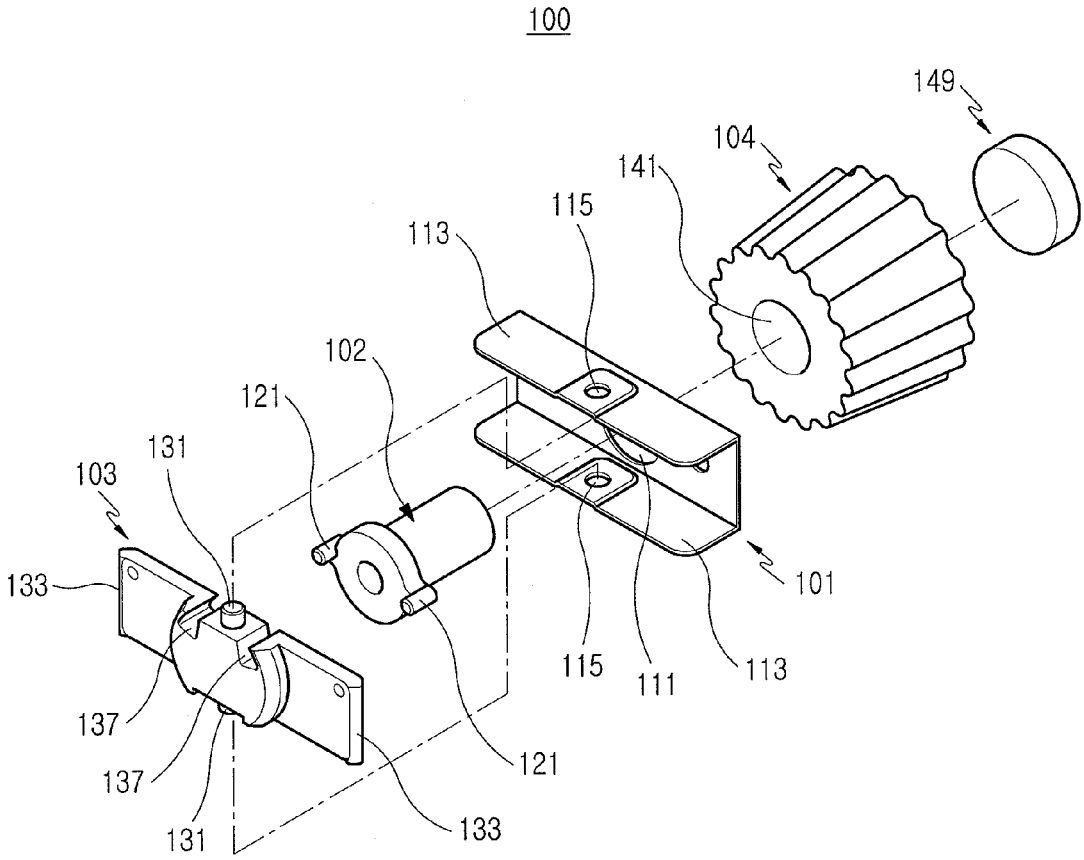
FIG. 1 is an exploded perspective view illustrating a two-way key of a portable terminal according to an exemplary embodiment of the present invention.
Figure 2:
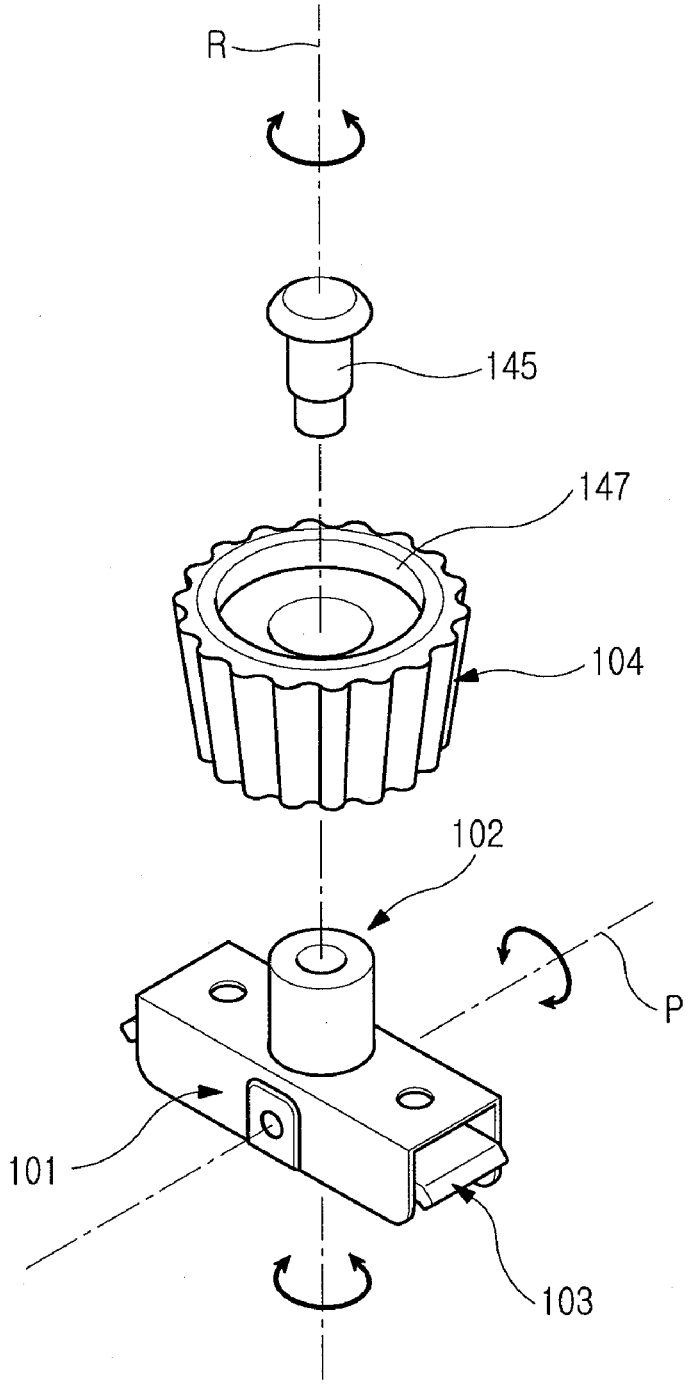
FIG. 2 is an exploded perspective view illustrating a driving member of the two-way key of FIG. 1 and a rotation grip, which are assembled with each other.
Figure 3:
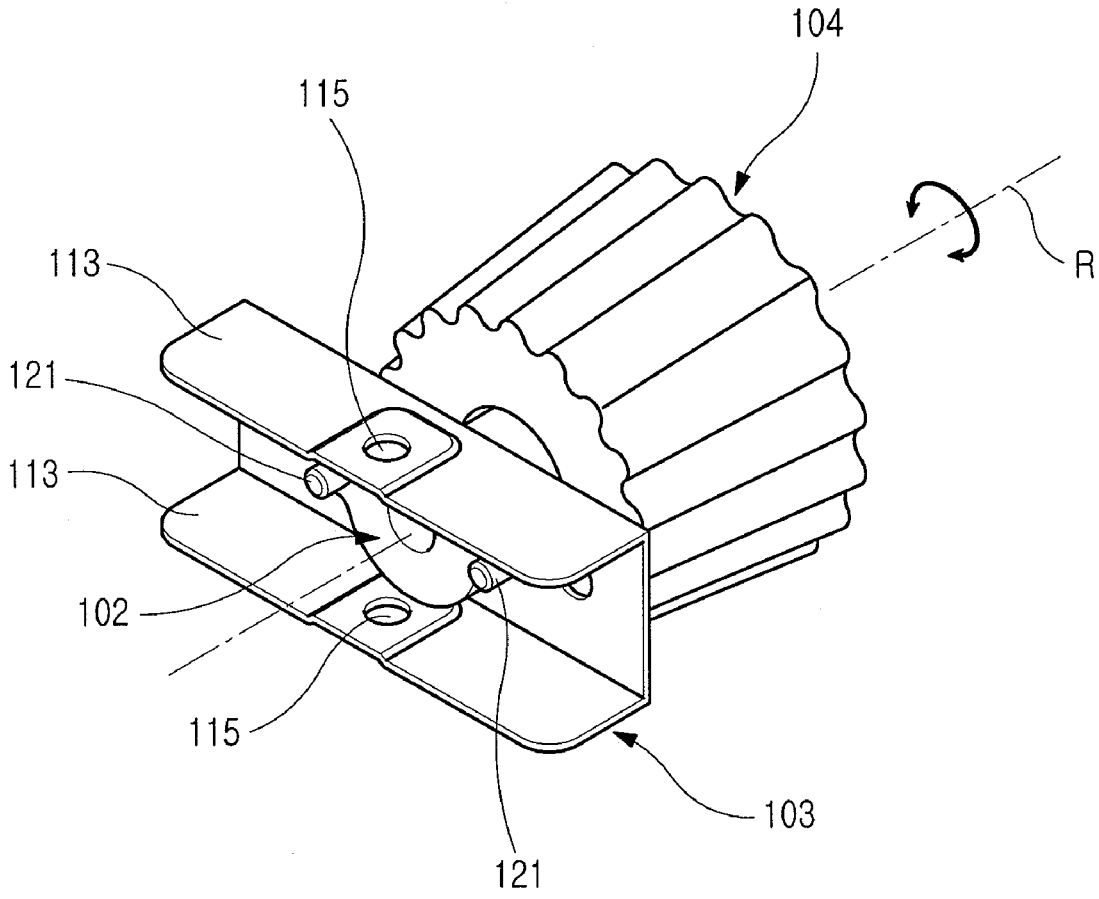
FIG. 3 is a perspective view illustrating the driving member of FIG. 2 assembled with a rotary knob.
Figure 4:
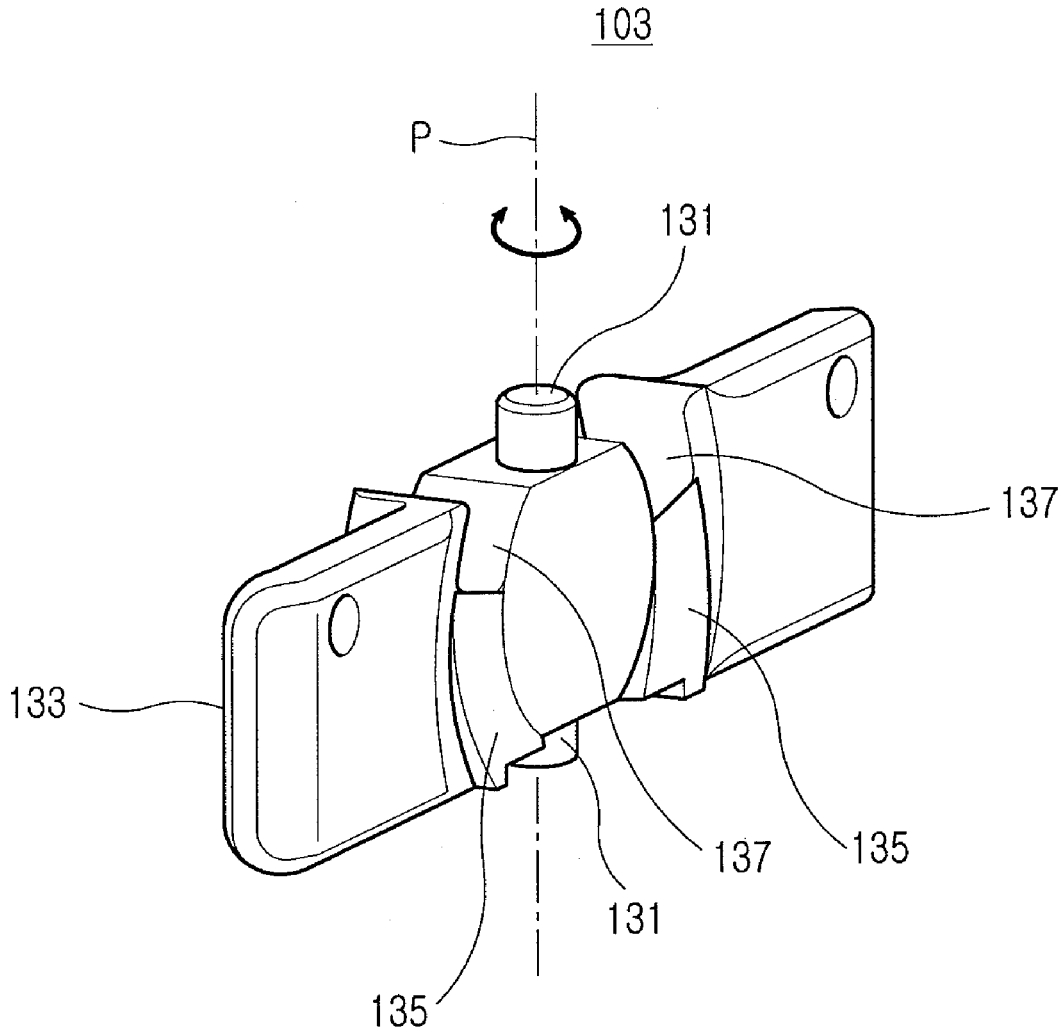
FIG. 4 is a perspective view illustrating an operation member of the two-way key of FIG. 1.
Figure 5:
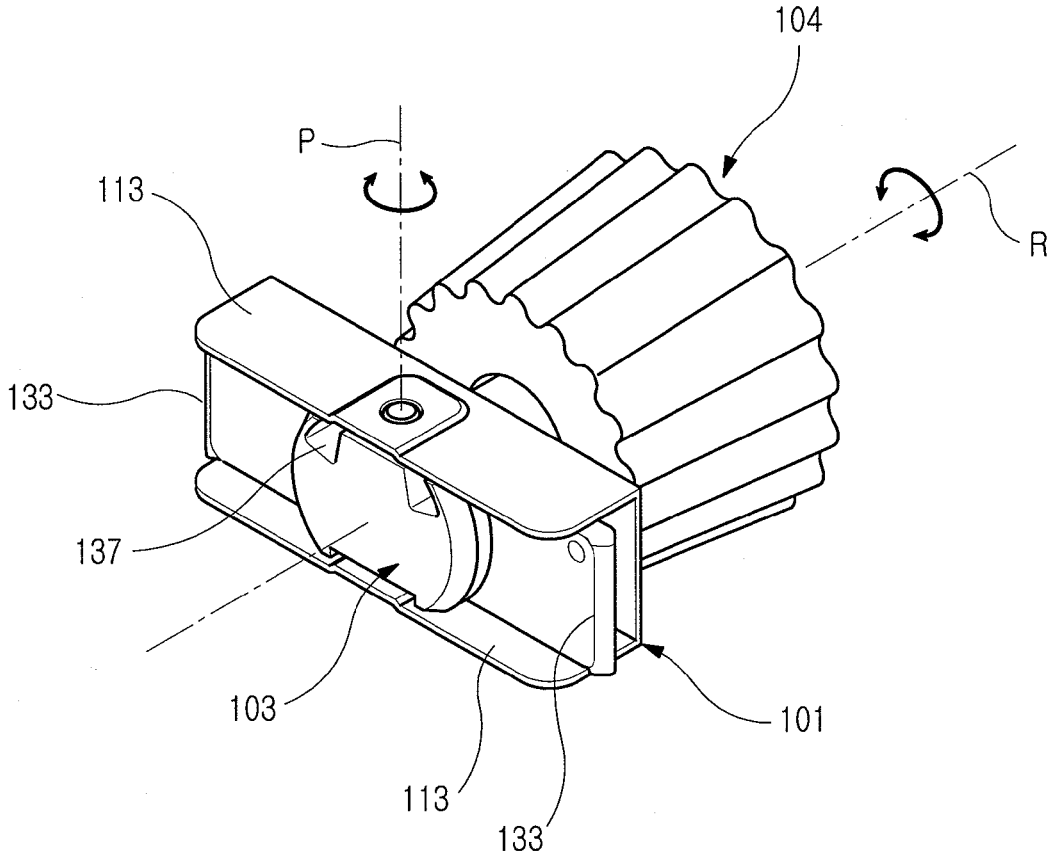
FIG. 5 is a perspective view illustrating an assembled two-way key of FIG. 1.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions, constructions and configurations are omitted for clarity and conciseness.

As shown in FIGS. 1 to 6, a two-way key 100 of a portable terminal 200 according to an exemplary embodiment of the present invention includes a driving member 102 and an operating member 103, which are positioned on the terminal and are assembled with a base 101. That is, the base 101 is fixed on an inner surface of the terminal 200 as a fixed member so that the driving member 102 and the operating member 103 are positioned on the terminal.

The base 101 is shaped like a plate and includes a pair of support ribs 113 which are formed by bending both sides thereof to face each other. The base includes a rotation hole 111 with which the driving member 102 is engaged. The support ribs 113 extend along a rotation axis R direction of the driving member 102 while facing each other, and pivot holes 115 are formed in each of the support ribs 113. A plurality of pivot pins 131 are formed in the operating member 103 and are each rotatably engaged with a pivot hole 115.

The driving member 102 is shaped like a cylinder extending in one direction, and includes, at an end thereof, a pair of driving protrusions 121. The driving member 102 is engaged with the rotation hole 111 and rotates on the base 101. The driving protrusions 121 extend in the direction of the rotation axis R and are positioned symmetrically relative to the rotation axis R. As the driving member 102 rotates, the driving protrusions 121 swivel around the rotation axis R.

The operating member 103 extends in a vertical direction relative to the rotation axis R, and both sides thereof are symmetrical to each other centering on the rotation axis R. Both sides of the operation member 103 are respectively provided with a protrusion portion capable of operating a switch member 109 (shown in FIG. 6) including a tact switch, a dome switch and the like. The pivot pins 131 each protrude from a side of the operating member 103 and are each rotatably engaged with a pivot hole 115 of the base 101 so as to form a pivot axis P.

A pair of inclined surfaces 135 (shown in FIG. 4) corresponding to the driving protrusions 121 is formed at the other surface of the operating member 103. The inclined surfaces 135 are formed in a shape of a circular arc within a range of a predetermined angle along a trace of the driving protrusions 121 formed by rotation of the driving member 102. If the driving member 102 rotates in a clockwise or counterclockwise direction, any one of the driving protrusions 121 comes into contact with the corresponding inclined surface 135 and then rotates the operating member 103. Additionally, a pair of escaping grooves 137 is formed in the operating member 103. Each of the escaping grooves 137 contacts one end of a respective inclined surface 135 and is positioned on a movement trace of a driving protrusion 121.

Regarding the escaping grooves 137, if the driving member 102 rotates and any one of the driving protrusions 121 comes into contact with the inclined surface 135, the operating member 103 pivots. At this time, the other driving protrusion 121 may make contact with the operating member 103. If the other driving protrusion 121 makes contact with the operating member 103, the pivot of the operating member 103 can not be performed smoothly. In this situation, if the one driving protrusion 121 comes into contact with the inclined surface 135, the escaping groove 137 provides a space for the other driving protrusion 121 to be positioned, thereby allowing it to smoothly pivot. That is, the escaping grooves 137 provide a space in which one of the driving protrusions 121 can be positioned upon rotation of the driving member 102.

Figure 7:
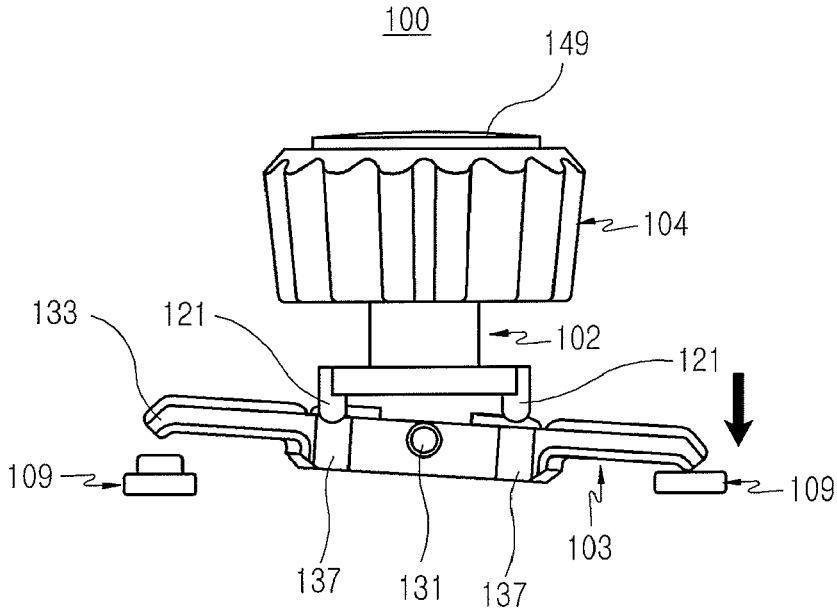
FIG. 7 is a side view illustrating the two-way key of FIG. 1 operated to one side.

The switch members 109 operated by the two-way key 100 include a pair of switch members, each of which faces one side of the operating member 103. Specifically, the operating member 103 includes protrusion portions 133 which are formed on lateral edges of the operating member 103. The protrusion portions 133 may be formed by bending lateral edges of the operating member 103. If the operating member 103 pivots, any one of the protrusion portions 133 operates the corresponding switch member 109, and the other protrusion portion 133 moves away from the corresponding switch member 109 as illustrated in FIG. 7.

In the meantime, in order to easily rotate the driving member 102, a rotary knob 104 can be mounted at an end of the driving member 102. The rotary knob 104 is provided with a plurality of grooves arranged in a peripheral surface thereof along a circumferential direction in order to prevent slippage when operating the knob.

A connection hole 141 having a shape corresponding to that of an end of the driving member 102 is formed in one surface of the rotary knob 104, and a fastening space 147 is formed in the other surface of the rotary knob 104. A fastening member 145, such as a screw, is fastened through the fastening space 147 and is engaged with the end of the driving member 102 so that the rotary knob 104 is fixed to the end of the driving member 102. The driving member 102 passes through the rotation hole 111 of the base 101, and the end thereof is assembled with the rotary knob 104 in such a manner that the base 101 is restricted between the driving protrusions 121 and the rotary knob 104. According to an exemplary embodiment of the present invention, the end of the driving member 102 and the connection hole 141 are each shaped like a circle. However, in an exemplary implementation, the driving member 102 has at least one plane in the peripheral surface of the end thereof, and the connection hole 141 is also made as a shape corresponding to that of the end of the driving member 102 in order to prevent the rotary rob 104 and the driving member 102 from slipping relative to each other when the rotary knob 104 rotates.

The fastening space 147 of the rotary knob 104 is covered by a decorative cover 149. Therefore, a head portion of the fastening member 145 is also covered by the decorative cover 149 so that it is not exposed to an exterior appearance of the two-way key 100, ultimately to an exterior appearance of the terminal in which the two-way key is mounted.

Figure 6:
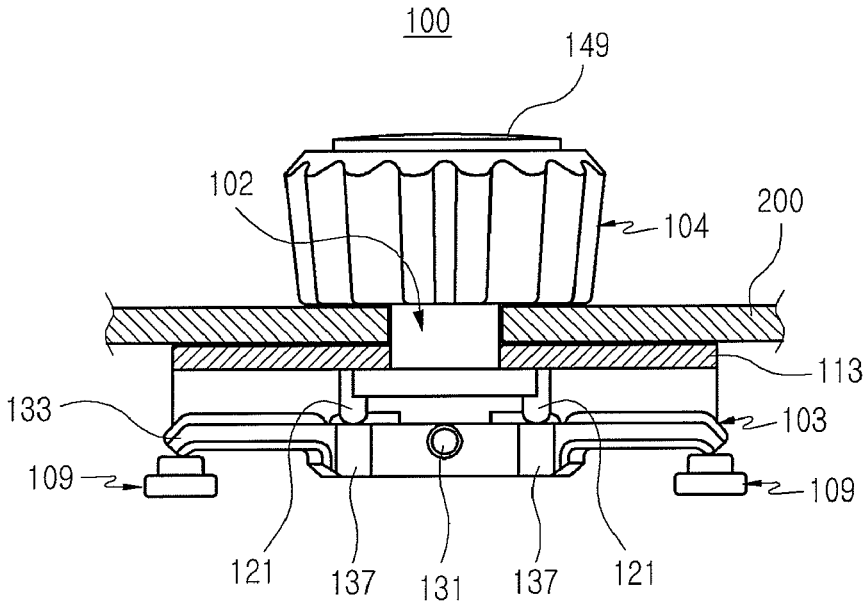
FIG. 6 is a side view illustrating the two-way key of FIG. 1 coupled to a portable terminal.
Figure 8:
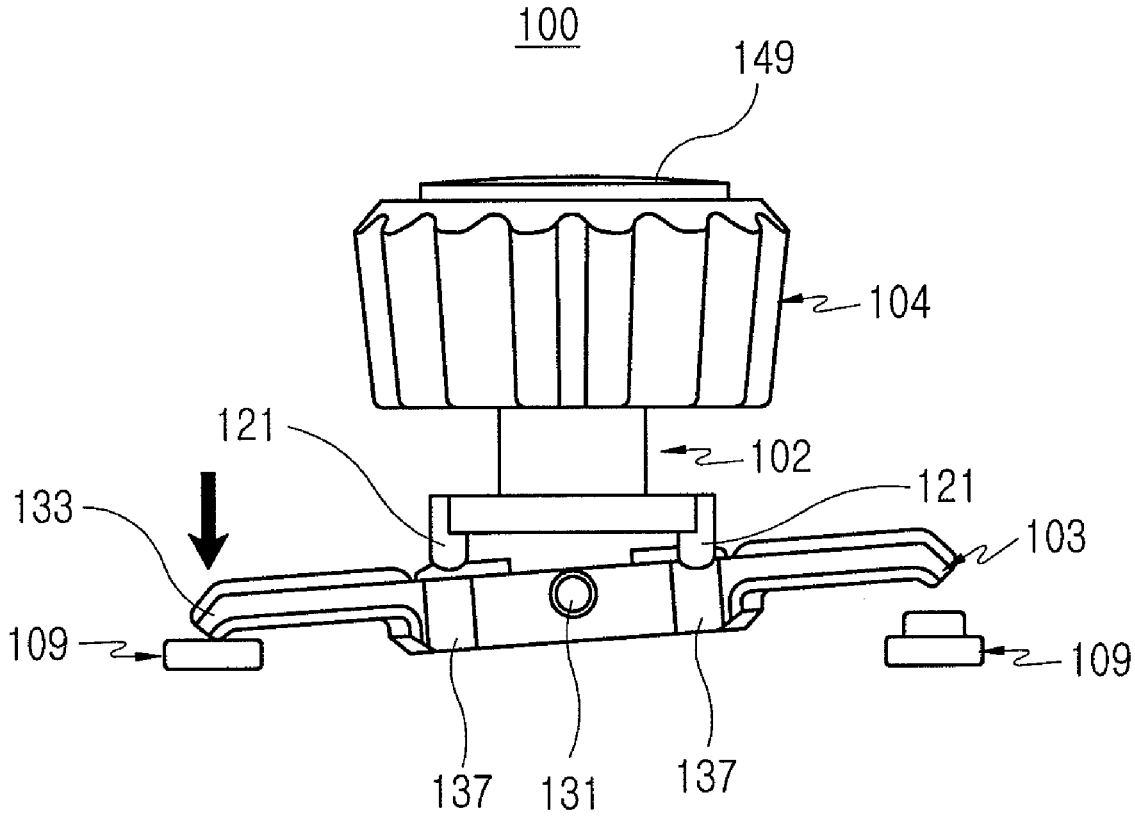
FIG. 8 is a side view illustrating the two-way key of FIG. 1 operated to the other side.

FIGS. 6 to 8 illustrate views in which the two-way key 100 is mounted, the switch member 109 positioned at one side of the operating member is operated, and the switch member 109 positioned at the other side of the operating member is operated, respectively. Here, the base 101 is omitted for clarity and conciseness so as to illustrate the operations of the two-way key 100 in FIGS. 6 to 8.

Referring to FIG. 6, a pair of switch members 109 is positioned at lower sides of the two-way key 100, especially at locations corresponding to the protrusion portions 133 of the operating member 103, respectively. The operating member 103 is symmetrically centered on not only the rotation axis R, but also the pivot axis P, and the switch members 109 are also symmetrically centered on the pivot axis P. The switch members 109 can include a dome switch or a tact switch employed in common portable terminals.

As illustrated in FIG. 6, if the two-way key 100 is not operated, the operating member 103 maintains a horizontal state, and the switch members 109 are not operated.

As illustrated in FIG. 7, if a user rotates the rotary knob 104 in a counterclockwise direction, the right driving protrusion 121 comes into contact with the inclined surface 135 and then rotates the operating member 103. At this time, the left driving protrusion 121 is positioned in the escaping groove 137 by rotation of the rotary knob 104 so that it does not contact the inclined surface 135, even though the operating member 103 pivots. As the right driving protrusion 121 contacts the inclined surface 135, the operating member 103 pivots to make the right protrusion portion 133 move downward so as to operate the switch member 109.

At this time, by controlling the inclination of the inclined surface 135, it is possible to set the rotation angle of the rotary knob 104, i.e., the driving member 102, which is required by the operating member 103 from when it starts to pivot to when it starts to operate the switch member 109. As the inclination of the inclined surface 135 is increased, the rotation angle of the driving member 102 required to reach the position where the switch member 109 is operated is decreased. In the meantime, as the inclination of the inclined surface 135 is decreased, the rotation angle of the driving member 102 required to reach the position where the switch member 109 is operated is increased. In an exemplary embodiment of the invention, the inclination of the inclined surface 135 is set for any one of the switch members 109 to be operated when the rotary knob 104 rotates in a clockwise or counterclockwise direction by approximately 40 degrees from an initial position.

The fact that the rotation angle of the driving member 102 required for operating the switch can be controlled by controlling the inclination of the inclined surface 130 should be easily understood by those skilled in the art.

If a user rotates the rotary knob 104 in a clockwise direction from a state of the right switch member 109 being operated, the switch member 109 is restored to an initial shape thereof, and the operating member 103 pivots to be in the horizontal state.

When a user desires to operate the left switch member 109, the user rotates the rotary knob 104 in a clockwise direction from the initial position. If the rotary knob 104 rotates in a clockwise direction from the initial position, the left driving protrusion 121 comes into contact with the inclined surface 135 and the right driving protrusion 121 is positioned in the escaping groove 137. Accordingly, as shown in FIG. 8, the operating member 103 pivots in a direction in which the left protrusion portion 133 contacts the switch member 109, and the left switch member 109 is operated.

In an exemplary implementation, the two-way key 100 configured as discussed above is mounted on a side of a housing of the portable terminal, for example a watch-type portable terminal, and it can perform two-way operation while taking a small mounting space so that it is suitable for a compact terminal.

As described above, an exemplary two-way key of the present invention can rotate the operating member in two ways by using rotation of the driving member, so there is an advantage that it can configure a key capable of operating in two ways while taking a small space. That is, the two-way key is configured to perform the two-way operation with a single key so that it contributes to the compact size of the terminal. Further, if the two-way key is employed in the watch-type portable terminal, the operating scheme is substantially similar to that of a spring of a common analog wrist watch or a time control lever, so that it is familiar to a user and thus it is convenient for use.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A two-way key comprising:

a fixed member;

a driving member, rotatable about a first axis, coupled to the fixed member; and an operating member, pivotable about a second axis, coupled to the fixed member and including two or more arms extending from the second axis, wherein, as the driving member rotates, the driving member comes into contact with the operating member and causes the operating member to pivot and further wherein the first axis is substantially orthogonal to the second axis.

2. The two-way key as claimed in claim 1, further comprising a plurality of tact switches, each of the plurality of tact switches positioned on a lateral side of a pivot axis of the operating member, wherein, as the operating member pivots, at least one of the plurality of tact switches is operated.

3. The two-way key as claimed in claim 1, further comprising a plurality of dome switches, each of the plurality of dome switches positioned on a lateral side of a pivot axis of the operating member, wherein, as the operating member pivots, at least one of the plurality of dome switches is operated.

4. The two-way key as claimed in claim 1, further comprising:

a pair of driving protrusions formed on the driving member; and a pair of inclined surfaces formed on the operating member, wherein, as the driving member rotates, one of the driving protrusions comes into contact with a corresponding inclined surface so as to pivot the operating member.

5. The two-way key as claimed in claim 4, further comprising a plurality of escaping grooves formed on the operating member, each of the escaping grooves contacting an end of one of the pair of inclined surfaces and positioned on a movement trace of one of the pair of driving protrusions, respectively.

6. The two-way key as claimed in claim 5, wherein, if one of the driving protrusions comes into contact with the respective inclined surface by rotating of the driving member, the escaping groove provides a space in which the other driving protrusion can be positioned.

7. The two-way key as claimed in claim 1, further comprising:

a pair of support ribs formed on a base of the fixed member and extending while facing each other;

a plurality of pivot holes, each of the plurality of pivot holes formed on one of the pair of support ribs, respectively; and a plurality of pivot protrusions, each of the plurality of pivot protrusions formed on one side of the operating member, respectively, wherein the pivot protrusions are rotatably coupled with the pivot holes, respectively.

8. The two-way key as claimed in claim 7, further comprising a rotary knob coupled to an end of the driving member, wherein the driving member passes through the base of the fixed member so as to be assembled with the rotary knob.

9. The two-way key as claimed in claim 8, wherein the rotary knob is coupled to the end of the driving member by a screw.

10. The two-way key as claimed in claim 9, wherein the screw passes through the rotary knob from an end of the rotary knob so as to be coupled to the driving member.

11. The two-way key as claimed in claim 10, further comprising a decoration cover mounted at the end of the rotary knob for covering a portion to which the screw is coupled.

12. The two-way key as claimed in claim 1, further comprising a plurality of switch members, each of the plurality of switch members positioned on a side of the operating member and positioned symmetrically centering on a pivot axis of the operating member, wherein, as the operating member pivots, one of the switch members is operated.

13. The two-way key as claimed in claim 12, wherein, if the driving member rotates by approximately 40 degrees, the operating member pivots and operates at least one of the plurality of switch members.

14. A portable terminal including a two-way key, the two-way key comprising:

a fixed member mounted on the portable terminal;

a driving members rotatable about a first axis, coupled to the fixed member; and an operating members pivotable about a second axis, coupled to the fixed member and including two or more arms extending from the second axis, wherein, as the driving member rotates, the driving member comes into contact with the operating member and causes the operating member to pivot, and further wherein the first axis is substantially orthogonal to the second axis.

15. The portable terminal as claimed in claim 14, further comprising a plurality of switches, each of the plurality of switches positioned on a lateral side of a pivot axis of the operating member, wherein, as the operating member pivots, at least one of the plurality of switches is operated.

16. The portable terminal as claimed in claim 15, wherein each of the plurality of switches comprises at least one of a tact switch and a dome switch.

17. The portable terminal as claimed in claim 14, further comprising:

a pair of driving protrusions formed on the driving member; and a pair of inclined surfaces formed on the operating member, wherein, as the driving member rotates, one of the driving protrusions comes into contact with a corresponding inclined surface so as to pivot the operating member.

18. The portable terminal as claimed in claim 17, further comprising a plurality of escaping grooves formed on the operating member, each of the escaping grooves contacting an end of one of the pair of inclined surfaces and positioned on a movement trace of one of the pair of driving protrusions, respectively.

19. The portable terminal as claimed in claim 18, wherein, if one of the driving protrusions comes into contact with the respective inclined surface by rotating of the driving member, the escaping groove provides a space in which the other driving protrusion can be positioned.

20. The portable terminal as claimed in claim 14, further comprising:

a pair of support ribs formed on a base of the fixed member and extending while facing each other;

a plurality of pivot holes, each of the plurality of pivot holes formed on one of the pair of support ribs, respectively; and a plurality of pivot protrusions, each of the plurality of pivot protrusions formed on one side of the operating member, respectively, wherein the pivot protrusions are rotatably coupled with the pivot holes, respectively.

* * * * *